United States Patent [19]

Magid et al.

[11] Patent Number: 4,679,706

[45] Date of Patent: Jul. 14, 1987

[54] DISPENSING SYSTEM WITH INFLATABLE BAG PROPELLING MECHANISM AND SEPARATE PRODUCT GAS PHASE

[75] Inventors: David J. Magid, Doylestown; Barbara Svitila, Wayne; William Kalriess, Quakertown, all of Pa.

[73] Assignee: Enviro-Spray Systems, Inc., Hoboken, N.J.

[21] Appl. No.: 666,202

[22] Filed: Oct. 29, 1984

[51] Int. Cl.[4] ..... B65D 83/14

[52] U.S. Cl. ..... 222/130; 222/399; 222/386.5; 222/402.18; 60/673

[58] Field of Search ..... 222/394, 399, 402.1, 222/130, 386.5, 402.18; 60/673, 721

[56] References Cited

U.S. PATENT DOCUMENTS

| | | | |
|---|---|---|---|
| 2,962,196 | 11/1960 | Ayres | 222/399 |
| 3,235,137 | 2/1966 | Bonduris | 222/386.5 |
| 3,245,435 | 4/1966 | Healy | 222/386.5 |
| 3,718,236 | 2/1973 | Reyner et al. | 222/386.5 |
| 4,265,373 | 5/1981 | Stoody | 222/402.18 |
| 4,376,500 | 3/1983 | Banks et al. | 222/386.5 |

*Primary Examiner*—H. Grant Skaggs

*Attorney, Agent, or Firm*—Kenyon & Kenyon

[57] ABSTRACT

A dispensing system for use with a wide variety of dispensable products which employs an inflatable pouch positioned within the container containing a pressurizing gas phase. A product gas phase is incorporated in the expelled product to enhance the product appearance, functionally or safety. The weight to weight (w/w) ratio of the product gas phase to the flowable materials should be between about 0.001:1 to about 0.015:1 and preferably, the w/w ratio of the product gas phase to the flowable material is between about 0.001:1 and about 0.07:1.

8 Claims, 4 Drawing Figures

DISPENSING SYSTEM WITH INFLATABLE BAG PROPELLING MECHANISM AND SEPARATE PRODUCT GAS PHASE

BACKGROUND OF THE INVENTION

This invention relates generally to a flowable material dispensing system adapted to dispense a wide variety of materials and more particularly to one wherein an inflatable pouch positioned within the container is utilized in conjunction with a propellant incorporated in the product to be dispensed. A variety of considerations, including cost, wasted product and flammability, have prompted considerable research and development activity in recent years aimed at finding alternative means to dispense various flowable material products.

The use of a fluid impervious, expandable bag containing gas generating components, such as that described in U.S. Pat. No. 4,376,500 issued to Banks et al., produces a relatively constant expulsion pressure during use, and overcomes certain problems existent in the prior art. In the Banks et al. patent, as described, the dispensing system expels flowable material product in a uniform spray. However, some product uses require a texture substantially different than a fluid texture, e.g., a foam shaving cream or a mousse hair product. While textured products have been previously known, deficiencies are present with respect to the uneven texture of the product as it is dispensed over the life of the container caused by the application of an uneven pressure maintained in the can as additional product is dispensed.

The present invention provides the advantages of the dispensing system employing an expandable bag containing gas generating means therein in conjunction with the utilization of a gaseous component in the product being dispensed to achieve a desired special effect.

It is accordingly an object of the present invention to provide an improved dispensing system which maintains consistent delivery of substantially all the product being dispensed and which product has particular predetermined characteristics.

A further object of the present invention is to provide a dispensing system utilizing qualities of incorporation of propellant, solvents or gases to enhance product appearance, functionality or safety in conjunction with an inflatable bag which produces a product that unlike conventional aerosols exhibits such desirable qualities while maintaining consistent delivery substantially throughout the life of the unit.

A still further object of the present invention is to provide an improved dispensing system which expels an even textured product under a substantially constant pressure throughout the life of the dispensing system.

These and other objects, advantages and features of the invention will become more apparent from the description herein taken in conjunction with the accompanying drawings.

SUMMARY OF THE INVENTION

The present inventive concept involves an expulsion means in an aerosol-type, flowable material product dispensing system wherein the expulsion means incorporates an inflatable bag containing a pressurizing gas phase and gas generating components. The dispensing system further incorporates a product gas phase, the product gas phase being disposed within the dispensing system but external to the pressurizing gas phase within the inflatable bag.

The gas generating components contained within the inflatable bag are separately compartmented so that upon admixture in successive aliquots, the gas generating components generate gas, increasing the number of moles of gas within the pressurizing gas phase and causing the bag to expand gradually from an unexpanded condition to an ultimately fully expanded condition. This expansion of the bag maintains the pressure within the pressurized container at a relatively constant level effective to expel the flowable material product from the container and thereby provide a relatively constant expulsion rate during use.

The product gas phase comprises a quantity of gas effective to modify the dispensed flowable material. However, unlike conventional aerosol systems, the product gas phase in the form of a compressed gas or liquid propellants or solvents is used to achieve the specific desired effects rather than as the pressure source. For instance, the product gas phase may be designed solely for the purpose of foam generation. Thus, depending on the nature of the gas utilized as the foaming agent, the resulting foam can be relatively wet, soft and creamy, or dry and fluffy in appearance. Proper choice of the foaming agent also enables the attainment of either an instant foam (e.g., with compressed gases) or a foam which will not develop until a desired time after delivery. Also, the propellants or compressed gases may be incorporated into flammable products in order to reduce and/or eliminate flame extension or flashback. Such product applications include hairsprays, deodorants, paints and high solvent automotive and industrial products.

The product gas phase may also be employed for purposes of spray pattern enhancement or to aid in the atomization of products of low or high viscosity. Thus, improved spray pattern characteristics may be produced exhibiting a wider, more uniform spray, and with a smaller particle size.

In addition, incorporation of the product gas phase into the product to be dispensed may be effective in causing a reduction in the spray rate of the product being dispensed. Such gases function as inert fillers, i.e., upon dispensing of the gas-laden product, volatilization of the filler gas occurs very quickly, leaving only the original product on the target area. The amount of actual product dispensed onto the target area over a given time of application is lower with a gas-incorporated product than with the same product without such a gas phase. In practicing this invention, propellants such as hydrocarbon propellants and derivatives thereof including, but not limited, to hexane, pentane, isopentane, butane, isobutane, propane, dimethyl ether or mixtures thereof may be used. Chlorofluorocarbons may also be used. Also compressed gases may be used including, but not limited to, carbon dioxide, nitrogen, oxygen, nitrous oxide and mixtures thereof.

DESCRIPTION OF THE PREFERRED EMBODIMENTS

The present invention is applicable to the delivery of a wide range of flowable materials including hair and skin mousses, shaving foams, shave gels, household and automotive cleaners, pan sprays, hair sprays, paints, high solvent automotive and industrial products, oil-based products, anti-perspirants, hair care products, personal and room deodorants, space sprays, etc. Flowable materials encompass materials possessing a wide degree of viscosity and thus include fluids, gels, viscous materials, flowable solids such as powders, and combinations thereof.

Figure 1:
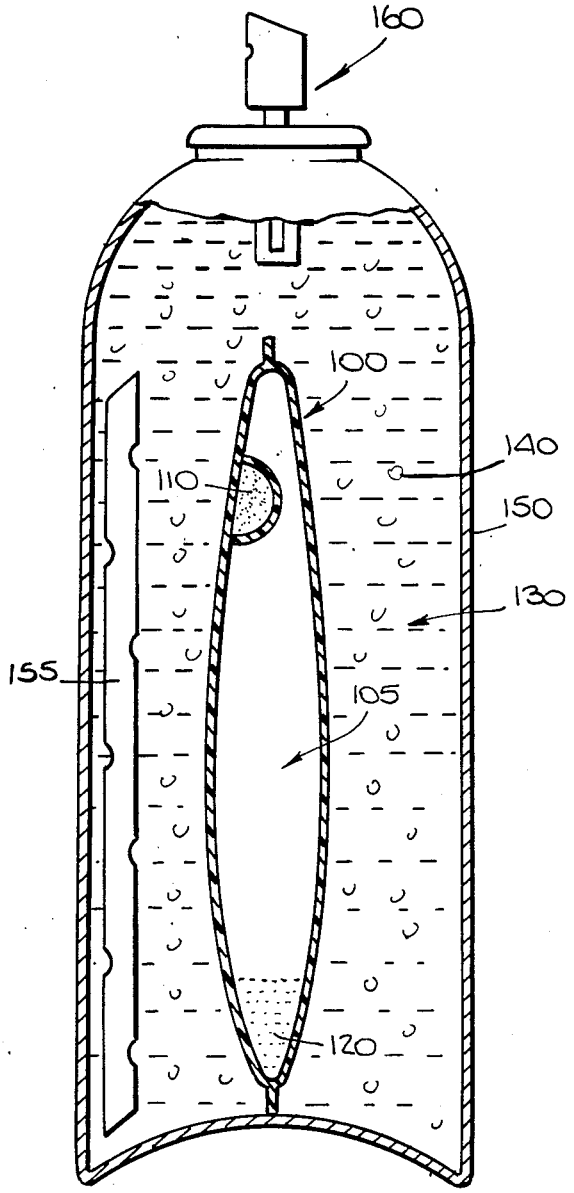
FIG. 1 is an elevation view, partially in cross-section, of a dispensing system according to the present invention incorporating an internal pressure developing means and a product gas phase external to said internal pressure developing means, but within the dispensing system.

Referring now to the drawings, the dispensing system according to the present invention is shown in FIG. 1. In this embodiment, the internal pressure developing means is a fluid impervious, inflatable bag 100 disposed within can 150 and containing a pressurizing gas phase 105 and gas generating components 110, and 120. In a preferred example of this embodiment, gas generating component 110 is one component of a two-component gas generating system, e.g., citric acid, and gas generating component 120, e.g., sodium bicarbonate, is complementary thereto. The sodium bicarbonate gas generating component may be in the form of time release beaded sodium bicarbonate as depicted or in capsule form. Also, the sodium bicarbonate may be provided in a partly hydrolyzed polyvinyl alcohol pouch which is water soluble. See for example U.S. Pat. No. 4,376,500 and Ser. No. 290,256 filed Aug. 5, 1981, now U.S. Pat. No. 4,478,044, issued on Oct. 23, 1984. One of the components, e.g., citric acid 110, is provided in a burstable compartment which is activated upon insertion into the can to commence the gas generating system. Pressurizing gas phase 105 constitutes the gas which is evolved by the admixture of gas generating components 110 and 120, e.g., carbon dioxide.

The dispensing system embodiment includes a flowable material product 130 and a product gas phase 140. The product gas phase 140 may be saturated into the flowable product 130 or laid on top of the product as desired. A conventional valve means 160 is sealably attached to can 150 and includes an opening in communication with the flowable product 130 in the dispensing system. Prior to capping and sealing valve 160 on to can 150, a perforated tube 155 is preferably inserted into the interior of can 150 to prevent trapping some of the liquid product 130 in the can and preventing dispensing thereof.

Figure 2:
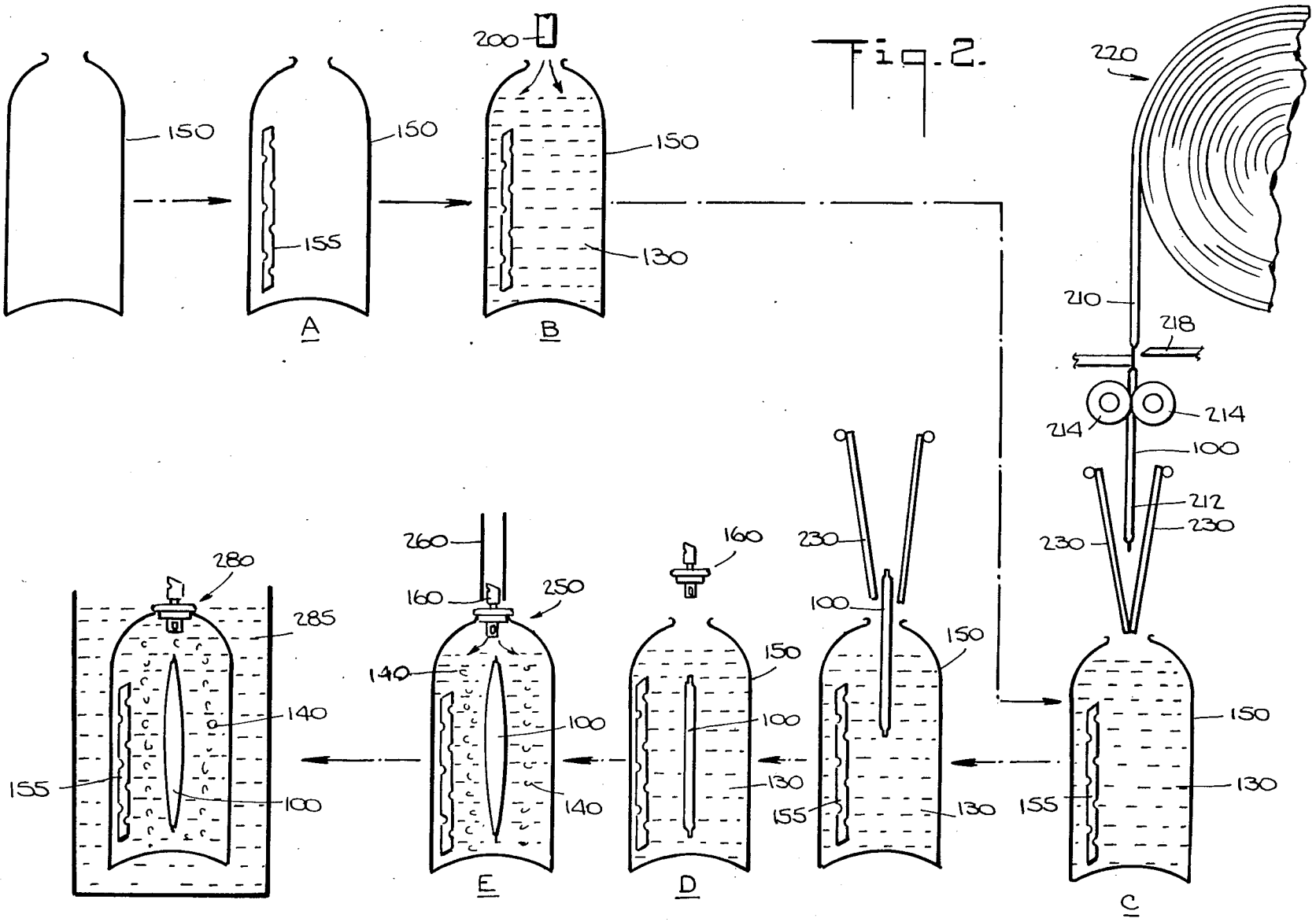
FIG. 2 is a schematic flowsheet depicting the assembly steps of an embodiment utilizing: a fluid impervious, inflatable bag as the internal pressure developing means; the flowable material product; and the gas phase external to the inflatable bag.

FIG. 2 shows one embodiment of a method of assembling the dispensing system of the present invention. In this embodiment, can body 150 is transported to Station A. At Station A, perforated tube 155 is inserted into the interior of can body 150 by any conventional delivery means.

Can body 150 containing perforated tube 155 is then transported to Station B, where flowable material product 130 is introduced into can body 150 by conventional nozzle means 200. After the proper quantity of flowable material product 130 is metered into can body 150, can body 150 with its contents is next transported to Station C.

At Station C, uninflated bag 100 is inserted into product 130 in can body 150. The fabrication of bag 100 may be effected in a continuous strip 210 providing a plurality of successive bags and in a supply roll 220, which roll may be delivered to automatic package assembly equipment shown schematically in FIG. 2. The package containing continuous strip 210 is delivered to Station C where the delivery end 212 of strip 220 is held at one side by rolls 214 and the leading bag member 100 is severed by cutting means 218 whereby bag 100 is delivered to receiving hopper 230 which is disposed over can body 150. Activation of the gas generating system is accomplished at Station C in a manner similar to that described in U.S. Pat. No. 4,376,500.

Hopper 230 opens to deliver bag 100 to the interior of can body 150. Thereafter, can body 150 containing perforated tube 155, flowable material product 130 and inflatable bag 100 is transported to Station D, where a conventional valve means 160 is sealably affixed to can 150. Crimping is a preferred means of sealably affixing the valve means 160 to the can body 150.

The capped, sealed system 250, is transported to Station E where gas delivery means 260 is attached to aerosol valve means 160 and product gas phase 140 is introduced into the product. After complete assembly, the fully activated container 280 is immersed in hot water bath 285, if necessary.

Figure 3:
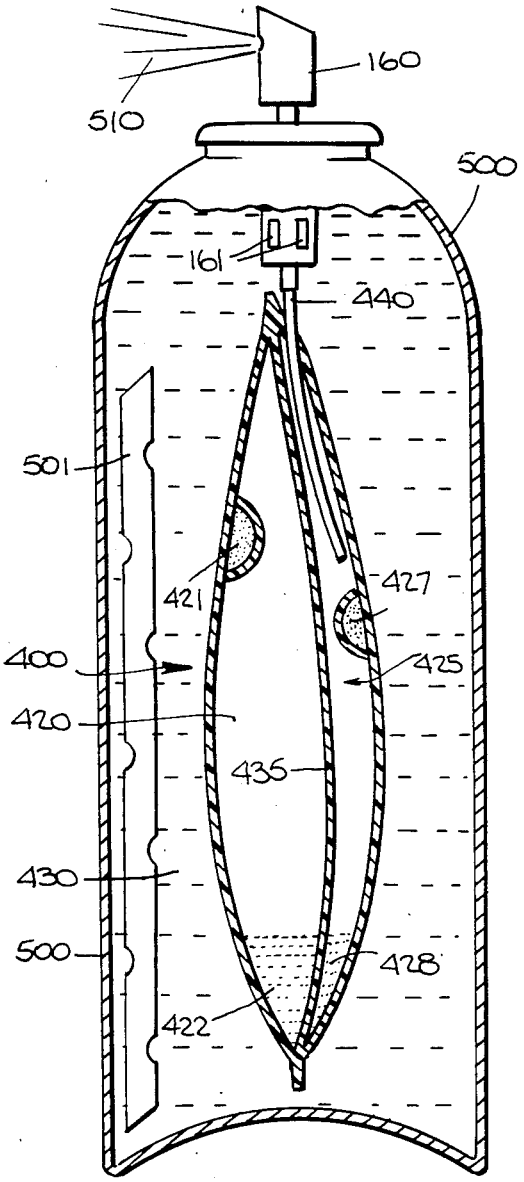
FIG. 3 is an elevation view, partially in cross-section, of an embodiment of the dispensing system of the present invention wherein the product gas phase is disposed within a discrete chamber within the dispensing system, external to the internal pressure developing means and in communication with the flowable material product by means of a delivery tube.

A further embodiment of the present invention is shown in FIG. 3 wherein container 500 includes flow tube 501 and valve means 160 which produces spray 510. Here the inflatable bag 400 consists of two compartments—the first, compartment 420, is non-gas permeable and contains the gas generating components 421–422 for the pressurizing gas phase, i.e., the gas phase needed to expel the product from the container. The second, compartment 425, contains gas generating components 427 and 428 for the product gas phase. Each compartment is separated from the other by common wall 435. Gas generating is accomplished in compartment 425 by a two component system which is activated in a manner similar to that of the first compartment 420 upon insertion of the bag into the can body. Gas generating component 427 is one component of the two component system, e.g., citric acid, and gas generating component 428, e.g., sodium bicarbonate, is complimentary thereto. Gas generating component 427 is housed in a rupturable bag which is caused to burst by rollers 214 upon insertion of the bag into can body 500. Gas generating component 428, in the form of time release beaded sodium bicarbonate, as depicted generates the product gas phase upon contacting the citrio acid 427 released from rupturable bag. Of course, the sodium bicarbonate may be provided as a capsule or in a water soluble pouch as well as other forms. The respective quantities of citric acid and sodium bicarbonate may be adjusted to reflect the particular product being dispensed.

Introduction of product gas phase into the product 430 from compartment 425 is achieved by transfer of the product gas phase from compartment 425 through gas delivery tube 440 into the valve means 160. Upon activation of valve means 160, product 430 flows into the valve means 160 through the side ports 161 of the valve where it mixes with product gas phase from compartment 425.

Figure 4:
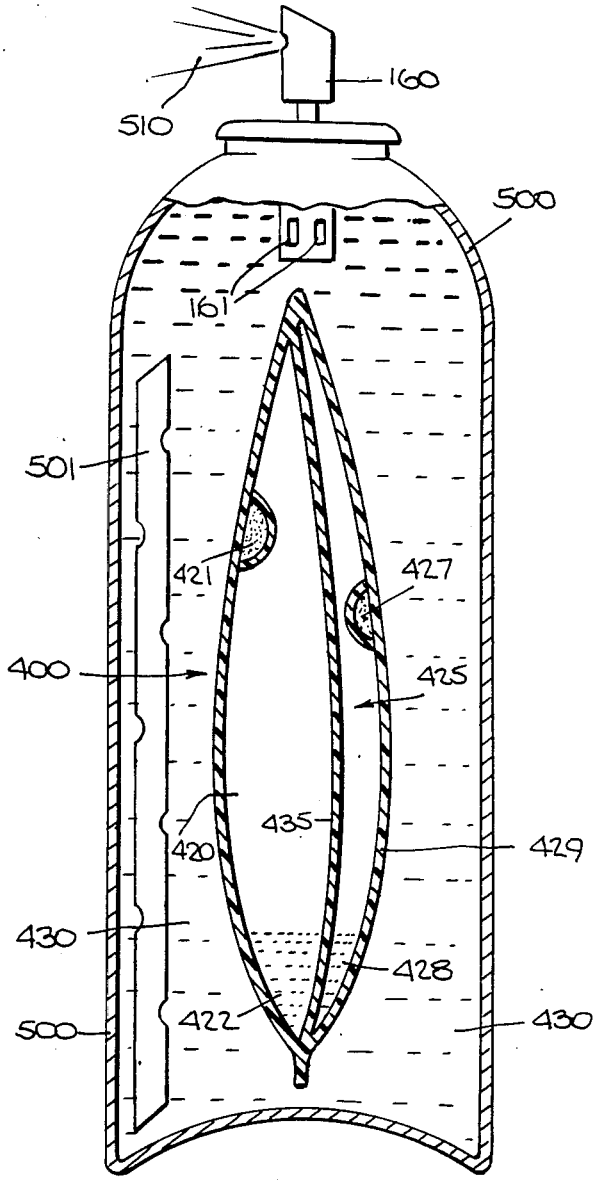
FIG. 4 is an elevation view, partially in cross-section, of an embodiment of the dispensing system of the present invention wherein the product gas phase is disposed within a discrete chamber within the dispensing system, external to the pressure developing means and in communication with the flowable material product through a portion of the chamber.

A modification of the FIG. 3 embodiment is depicted in FIG. 4 wherein inflatable bag 400 is provided with a gas permeable wall to facilitate introduction of the product gas phase into the product to be expelled. The construction of container 500, valve 160, flow tube 501 and inflatable bag 400 is the same as that of FIG. 3 except for the removal of gas delivery tube 440.

To facilitate introduction of the product gas phase into the product 430, compartment 425, again contains gas generating components 427 and 428 for the product gas phase. Gas generating is accomplished in compartment 425 by the two component system in a manner similar to that described with respect to FIG. 3.

Introduction of product gas phase into the product 430 from compartment 425 is achieved by transfer of the product gas phase from compartment 425 through outer wall 429 thereof. Outerwall 429 is specifically designed to be gas permeable to enable the product gas phase generated with compartment 425 to pass therethrough and into the product 430. Outerwall 429 is preferably constructed of a low density polyethylene material of approximately one and one-half mils in thickness or other low density material.

Upon activation of gas generating components 427 and 428, as sufficient gas volume is developed to expand chamber 425, leakage of the generated product gas phase will occur through wall 429 into product 430. By selecting adequate amounts of gas generating components 427 and 428, gas saturation of product 430 to be dispensed may be accomplished. Utilization of a hot water bath may be employed to accelerate permeation of the product gas phase through wall 429. Generally, at temperatures above 100° F., materials such as polyethylene are permeable to allow for rapid gas saturation of the product being dispensed.

Many of the desired textural attributes of the present invention are produced by a component that is substantially completely volatized within about ten minutes of the delivery to the target area. Such components which volatize from the admixture with another component comprise volatile solvents and gaseous materials and will be referred to herein as the product gas phase. Preferably the product gas phase is soluble in the flowable material product at temperatures up to about ambient. It is further preferred that the product gas phase component is dissolved in the flowable material product prior to generating the internal pressure developing means within the dispensing system. The product gas phase can be dissolved in the flowable material product by any suitable method of dissolving a gas in another material appropriate for the product gas phase and flowable material product combination.

The flowable material product itself is introduced into the dispensing container by any conventional means. For example, the flowable material product may be introduced into the dispensing container via a nozzle means prior to capping the dispensing container.

In the fully assembled dispensing system, the dispensing system's internal pressure, is effective to expel the flowable material product from the dispensing system. The internal pressure generating means which develops and maintains the dispensing system's internal pressure is a fluid impervious, inflatable bag containing gas generating components. An example of this type of fluid impervious, inflatable bag containing gas generating components is disclosed in U.S. Pat. No. 4,376,500, which is hereby incorporated by reference. After the dispensing system is fully assembled, the inflatable bag is in a substantially unexpanded condition. The inflatable bag containing gas generating components maintains the dispensing system's internal pressure at an approximately constant level effective to deliver an admixture of the flowable material product and the product gas phase. The inflatable bag maintains the dispensing system's internal pressure by combining successive aliquots of the gas generating components. When combined, these gas generating components evolve a gas, which gas comprises part of the pressurizing gas that maintains the dispensing system's internal pressure at the level effective to expel further flowable material product.

The product gas phase may be the same type of gas as the pressurizing gas phase or may be a gas different from the gas constituting the pressurizing gas phase. The weight to weight (w/w) ratio of the product gas phase to the flowable material should be between about 0.001:1 to about 0.15:1 and preferably, the w/w ratio of the product gas phase to the flowable material is between about 0.001:1 and about 0.07:1.

The product gas phase may usefully include hydrocarbons propellants, compressed gases, chlorofluorocarbons, and combinations thereof. Hydrocarbon propellants and derivatives thereof useful in the product gas phase comprise propane, butane, isobutane, pentane, isopentane, hexane, dimethyl ether, chlorofluorocarbons (such as freons) and combinations thereof. Compressed gases which may usefully be employed in the product gas phase comprise carbon dioxide, nitrogen, oxygen, nitrous oxide and combinations thereof.

While conventional methods of combining the flowable material product with the product gas phase may be used, preferred methods of combining the flowable material product with the product gas phase include saturation methods, gas-shaker methods, gassing methods, and in-line mixing.

The saturation method of combining flowable material with product gas phase can be accomplished by chilling the flowable material and dispensing a mist of the flowable material into a chamber wherein the atmosphere within the chamber is the product gas phase components.

A further preferred gas-shaker method for combining the flowable material with the product gas phase includes, after the other components of the dispensing system have been combined and sealed within the dispensing system, adding the product gas phase to the dispensing system through the dispensing system valve means and agitating the dispensing system concurrent with the product gas phase addition.

A preferred in-line mixing method for combining the flowable material product with the product gas phase includes combining the flowable material with the product gas phase before the flowable material is introduced into the dispensing system container. It is further preferred that the in-line mixing method include controlling the operating temperatures at or below about the ambient temperature and controlling the operating pressures. It will be recognized that the temperature and pressure selected will reflect the properties of the flowable material and the product gas phase.

Although the following Examples are provided to illustrate the present invention, it is to be understood that modifications and variations may be resorted to without departing from the spirit and scope of the invention as those skilled in the art will readily understand. Such modifications are within the scope of the invention and appended claims.

EXAMPLE 1

A pan spray was prepared by admixing:
Soybean oil: 166 gm
Alcohol: 24 gm
Lecithin: 6 gm This admixture was transferred to a dispensing system container. Thereafter, a fluid impervious inflatable bag containing gas generating components was placed within the dispensing system container, a cap and valve means were added and the dispensing system was sealed. Carbon dioxide, 4 gm, were then added to the dispensing system via the valve means. Finally, the inflatable bag was activated to provide the dispensing system with an internal pressure effective to expel an aerosol of the flowable material product admixture and carbon dioxide.

EXAMPLE 2

A pan spray dispensing system according to Example 1 was produced, but without adding the carbon dioxide product gas phase.

The advantages of the Example 1 pan spray over the Example 2 spray were readily apparent upon comparing these two sprays. Whereas the Example 1 pan spray dispensing system dispensed a mist of product droplets, the Example 2 dispensing system dispensed a stream of product. Moreover, the user of the Example 1 spray was also better able to control the amount of the flowable material product admixture coated onto a pan than the user of the Example 2 spray.

(DATA)

EXAMPLE 3

A hair mousse was prepared by admixing:
SD Alcohol 40: 40 gm
Water: 147 gm
Polyquaternium 11: 4 gm
Dimethicone Copolyol: 1 gm
Hydrolyzed Animal Protein: 2 gm
Fragrance: 1 gm This admixture was transferred to a dispensing system container, a fluid impervious, inflatable bag containing gas generating components was placed within the dispensing system container, a cap and a valve means were added and the dispensing system was sealed. Nitrous oxide, 5 grams, was then added to the dispensing system via the valve. The dispensing system was agitated concurrently with the nitrous oxide addition by a gasser shaker. Thereafter the inflatable bag was activated to provide the dispensing system with an internal pressure effective to expel an aerosol of the flowable material product admixture and nitrous oxide.

EXAMPLE 4

A hair mousse according to Example 3 was produced, but without adding the nitrous oxide.

Comparing the Example 3 and Example 4 hair mousses revealed a considerable difference. The Example 3 hair mousse was a soft, creamy, foam when dispensed, whereas the Example 4 hair mousse was a liquid.

What is claimed is:

1. An apparatus for developing an internal pressure within a dispensing system adapted to dispense a flowable product and for introducing a gas into the product to be dispensed which comprises:

an inflatable bag with at least two chambers being substantially impervious to the flowable product to be dispensed which includes a pressurizing gas phase chamber and an integral product gas phase chamber separate and isolated therefrom, said pressurizing gas phase chamber including therein gas generating components which upon admixing generate gas and increase the number of moles of gas present in said pressurizing gas phase, said gas pressurizing phase chamber walls being non-gas permable, said product gas phase chamber including therein gas generating components which upon admixing generate gas and increase the number of moles present in said product gas phase, and means for transferring said product gas phase from said separate compartment into the flowable product to be dispensed from the dispensing system.

2. An apparatus products according to claim 1 wherein said flowable product is admixed with said product gas phase at a weight to weight ratio of said product gas phase to flowable material between approximately 0.001:1 to about 0.15:1.

3. An apparatus products according to claim 1 wherein said weight to weight ratio of said product gas phase to flowable material is between about 0.001:1 and about 0.07:1.

4. An apparatus products according to claim 1 wherein said product gas phase is dispersed in said flowable product in a substantially fully saturating amount with respect to said fluid product.

5. An apparatus according to claim 1 wherein said transferring means comprises conduit means having one end thereof disposed in said product gas phase chamber of said inflatable bag and the other end thereof adapted to be coupled to a valve means provided in the dispensing system whereby upon activation of said valve means said flowable product flows into said valve means where it mixes with said product gas phase delivered from said product gas phase chamber.

6. An apparatus according to claim 1 wherein said transferring means comprises a gas permeable wall forming the outward side of said product gas phase chamber to facilitate the introduction of the product gas phase within said product gas phase chamber into the flowable product to be dispensed.

7. An apparatus according to claim 6 wherein said gas permeable wall comprises a low density polyethylene material of approximately one and one-half mils in thickness.

8. A dispensing system for discharging a substantially even textured flowable product therefrom under substantially uniform pressure comprising:

(a) a dispensing container;

(b) valve means sealably attached to said dispensing container;

(c) a flowable product disposed within said dispensing container;

(d) an inflatable bag substantially impervious to said flowable product which includes an isolated non-gas permeable chamber containing a pressurizing gas phase generated by gas generating components which upon admixing in the chamber generate gas and increase the number of moles of gas present in said pressurizing gas phase, said inflatable bag being disposed within said fluid product;

(e) a product gas phase disposed within said dispensing container adapted to be dispensed along with said flowable product under a substantially uniform pressure and with a substantially even texture wherein said product gas phase is a gas disposed in a separate chamber of said inflatable bag, said separate chamber including therein gas generating components which upon admixing generate gas and increase the number of moles present in said product gas phase, and wherein said dispensing system further includes means for transferring said product gas phase gas from said separate chamber into said flowable product disposed within said dispensing container; and (f) said transferring means comprises conduit means having one end thereof disposed in said separate chamber of said inflatable bag and the other end thereof coupled to said valve means whereby upon activation of said valve means said flowable product flows into said valve means where it mixes with said product gas phase gas from said separate chamber.

* * * * *